US006341921B1

(12) United States Patent
Anderson et al.

(10) Patent No.: US 6,341,921 B1
(45) Date of Patent: Jan. 29, 2002

(54) SELF-ADJUSTING LUMBAR SUPPORT FOR BUOYANCY COMPENSATOR VEST

(76) Inventors: Steve Anderson, 24 Silkwood La., Las Flores, CA (US) 92688; Lisa Glossinger, 969 Wren Way, San Marcos, CA (US) 92069; Shawn DeKalb, 12674 Buckwheat Ct., San Diego, CA (US) 92129; Janet Hsiao-wo Hu, 4937 Avila Ave., Carlsbad, CA (US) 92008; Gabriella Barrington, 10a Ellerdale Road, London, N.W.3., 6BB (GB); Jeffrey Kelly Allsop, 594 Via Armado, Chula Vista, CA (US) 91910

( * ) Notice: Subject to any disclaimer, the term of this patent is extended or adjusted under 35 U.S.C. 154(b) by 0 days.

(21) Appl. No.: 09/569,355

(22) Filed: May 11, 2000

(51) Int. Cl.[7] ..... B63C 11/02
(52) U.S. Cl. ..... 405/186; 405/185; 441/106
(58) Field of Search ..... 403/185, 186; 441/80, 88, 92, 96, 106, 108, 111, 114–119

(56) References Cited

U.S. PATENT DOCUMENTS

| | | | | | |
|---|---|---|---|---|---|
| 4,137,585 | A | * | 2/1979 | Wright, III | 9/314 |
| 4,681,552 | A | * | 7/1987 | Courtney | 441/108 X |
| 4,690,314 | A | * | 9/1987 | Faulconer et al. | 441/90 X |
| 4,779,554 | A | * | 10/1988 | Courtney | 405/186 X |
| 4,952,095 | A | * | 8/1990 | Walters | 405/186 |
| 4,990,115 | A | * | 2/1991 | Vorhauer et al. | 441/108 X |
| 5,249,890 | A | * | 10/1993 | Bergstorm | 405/186 |
| 5,256,094 | A | * | 10/1993 | Canna | 441/96 |
| 5,346,419 | A | * | 9/1994 | Kaiser | 441/96 |
| 5,363,790 | A | * | 11/1994 | Matsuoka | 405/186 X |
| 5,620,282 | A | * | 4/1997 | Stinton | 405/186 |
| 5,902,073 | A | * | 5/1999 | Eungard et al. | 405/186 X |
| 5,953,750 | A | * | 9/1999 | Stella | 441/106 X |
| 6,120,213 | A | * | 9/2000 | Stinton | 405/186 |

FOREIGN PATENT DOCUMENTS

| | | | | |
|---|---|---|---|---|
| EP | 360636 A1 | * | 3/1990 | 405/186 |
| EP | 581524 A1 | * | 2/1994 | 441/116 |

* cited by examiner

*Primary Examiner*—David Bagnell
*Assistant Examiner*—Jong-Suk Lee
(74) *Attorney, Agent, or Firm*—John J. Murphey

(57) ABSTRACT

A buoyancy compensator vest, for providing buoyancy at various underwater depths, having a rigid back board, for supporting an air tank vertically on the rear surface of the board at the back of the diver, surrounded in part by a bladder, for inflating and deflating, and a vest back panel including a pair of spaced-apart over-the-shoulder straps projecting from the top panel edge for joining with a pair of side portions extending about the chest of the diver, and a waist belt passing from behind the compensator vest about the panel side portions and the user's waist to complete the vest, the improvement of a pouch, defined by front and rear surfaces and including an openable panel to expose the interior thereof, the pouch interposed the back board and the scuba diver's back and containing a cushion for placement against the back of the diver, to cushion the back board and tank against the diver's spine, the pouch having openings formed therein to allow filling and draining of water during underwater activities, and a flexible strap located in the pouch, pre-bowed outward toward the diver's back and arranged so that the flexible bow is non-collapsible.

24 Claims, 5 Drawing Sheets

13
3
15
27
49
17
41
47
45
51

13
7
3
17
27
49
5
41
47
45
51

1
55
29
5
33
39
27
49
17
45
43
51
19
53
43
27
4-7
4-7
21
43
55
37
43
29

SELF-ADJUSTING LUMBAR SUPPORT FOR BUOYANCY COMPENSATOR VEST

BACKGROUND OF THE INVENTION

1. Field of the Invention

This invention pertains to equipment worn by divers for underwater activities. More particularly, it pertains to buoyancy compensators and vests worn by divers who use containers or tanks of breathable gas during their underwater dives. The invention is specifically directed to a lumbar support device that prevents injury to the backs of divers whose body size is not wholly compatible with many diving vests that hold the large gas tanks.

2. Description of the Prior Art

Scuba diving or under water breathable diving has evolved over the years from the original large, heavy air tank mounted on a stiff backboard strapped to the diver's back to the more modern use of a buoyancy compensating vest worn about the divers torso that holds the tank and also is inflatable and employs some cushioning under the air tank mounting board. This cushioning provides a measure of comfort to the diver during underwater activities as the tank is separated but a short distance from the diver's back and often injures the diver if not properly placed and adequately cushioned. When out of the water, these heavy tanks can cause substantial injury to the diver if they are not cushioned very carefully according to the size and body structure of the diver.

The modernization of scuba diving has brought more people into the sport. This new crop of divers range in age from the teens to senior citizens and includes persons of all size and shape and of differing height. The air tank, however, has remained the same, i.e., it is large and heavy. While some of this bulk and weight is relieved during the under water activities where the water helps support the tank, walking about wearing the tank and other equipment out of the water and moving about the boat or other water craft prior to and following diving activity continues to be a problem for many people. Even under water activities with cushioned air tanks can cause problems of uncomfortableness for persons of small stature.

The prior art has attempted to solve this problem in two ways: first, U.S. Pat. No. 4,779,554 discloses an inflatable "trim" bladder, located between the diver's back and the backpack on which the breathable gas (hereinafter "air") tank is mounted for possible inflation by the diver to trim his excessive weight and stabilize his position in the selected depth of the water. This bladder, when inflated, will separate the rigid surface of the backpack and air tank to which it is mounted from the diver's swimsuit and reduce contact therebetween. However, when the diver chooses not to inflate the bladder, there is no relief for the diver from contact from the tank or backpack. In addition, when the diver is out of the water, the bladder is not inflated. Further, a person of short stature may not obtain any relief from the bladder, whether inflated or not.

Another prior art attempt to provide relief from the discomfort of the backpack and tank is to actually place the buoyancy compensator itself between the tank and the diver's back. As disclosed in U.S. Pat. No. 4,137,585, a buoyancy compensator is provided that, when inflated by exhaust air from the breathing cycle, inflates and separates the back board and the attached air tank from the diver's back. Again, while this provides some relief in the water, it provides no relief out of the water or to those whose stature is incompatible with the large, heavy tank.

There is also a recent practice to provide a pouch between the backpack and the rear of the diver's suit, having openings in the skin of the pouch to allow it to be filled with water during a dive that is drained upon emergence from the water, where the pouch is also filled with reticulated foam to provide inflation, drainage, and support. However, while this provides some relief, it is not adjustable for persons of different size or who have short torsos so that the long air tank might strike them on the illiac crest or in the region between the hips and injure them.

SUMMARY OF THE INVENTION

This invention is an improvement in the vest and buoyancy compensator (hereinafter "buoyancy compensator vest") for wearing by scuba divers to provide not only buoyancy, in under water activities, but to provide non-collapsible support to their spine, kidneys and illiac crest for both in-water and out-of-water activities while wearing the tank. The buoyancy compensator vest is generally formed in a configuration that starts with a rigid back board, defined by a front and rear surfaces, for supporting the air tank vertically thereon at the back of the diver, and is surrounded in part by the inflatable bladder and a panel. The panel may or may not be inflatable itself but is defined by spaced-apart top and bottom edges, and spaced-apart side edges, all the edges joined together at their intersecting corners. The panel further includes a pair of spaced-apart straps that extend from the top edge of the panel over the diver's shoulders for joining with a pair of spaced-apart side portions that extend from the panel side edges about the chest of the diver to complete the vest part of the buoyancy compensator vest. One or more belts anchored to the back board pass about the panel side portions and buckles at the front of the diver's waist to hold the vest, back board, and buoyancy compensator in place.

The improvement of this invention includes a pouch, defined by front and rear surfaces and an openable panel to expose the interior thereof. The pouch is mounted or made an integral part of the vest portion of the buoyancy compensator vest and is juxtaposed or placed closely in front of the diver's back, under the back board, and contains a cushion for placement against the back of the diver, to cushion the back board and tank against the diver's spine. The pouch has openings formed therein to allow it to fill with water during underwater activities and to drain that water following exiting from the water. In another embodiment of the invention, a pair of spaced-apart kidney-shaped support cushions, each of a thick-to-thin cross-sectional design, are provided on the sides of the panel, over the kidneys, to protect them when the user swings side-to-side such that the heavy air tank can possibly batter against the lower back of the user. Under water, the kidney-shaped cushions help stabilize the tank along the user's spine for better balance and protection against injury from the tank.

A unique flexible strap is located in the pouch, between the cushion in the pouch and the front surface thereof and is arranged in vertical orientation therein. The novel aspect of this invention is that the strap is pre-bowed outward toward the diver's back and has fixed upper and lower ends so that the flexible bow is non-collapsible. This means that, as a portion of the bow is depressed or pushed inward toward the diver, such as from the heavy weight of the air tank, another part of the bow extends outward to force the back board slightly away from the diver's spine and other internal organs. Because the strap is pre-bowed and its ends anchored against movement, there is no place on the bow can it be totally collapsed because of the balance of the bow moving against the collapsing force. This means that the air tank and other heavy equipment attached to the back pack can never touch the diver's back. Thus, all divers, regardless of their height, girth, and torso length, will be protected from contact with the heavy and cumbersome air tank. This is particularly advantageous for women and small children who take up the sport but encounter difficulty wearing the air tank in a facile manner against their back because of their small size. Preferably, the upper end of the flexible, pre-bowed strap is fixed to the back board and the lower end of the strap is fixed to the panel to insure the pre-bow remains in the strap regardless of the position of the back board on the diver. At all times, this inventive device is to be positioned for the bottom end of the strap to be located above the illiac crest of the diver's torso.

In this novel improvement, the strap may be made of plastic to reduce the likelihood of corrosive effects of the water. The cushion in the pouch, usually positioned under the strap, can also contain reticulated foam for ease in filling and draining water therefrom. Even further, the openable panel of the pouch is located at the front surface of the pouch for ease in opening it to address the strap. Another novel feature of this invention is to include means for adjusting the vertical position of the strap to compensate for divers of different length torsos. One way to achieve this improvement is to provide means for moving at least one end of strap flexible strap upward and downward on the panel. Another way is to provide means for moving both ends of the flexible strap upward and downward in unison.

Accordingly, the main object of this invention is an improvement in scuba diving equipment wherein a pre-bowed strap is incorporated into the buoyancy compensator vest, between the air tank-mounting back board and the diver's back to provide insurance against the tank coming into contact with the diver's back and spine. Other objects of this invention include a buoyancy compensator that is amenable to fit a wide range of persons having a wide variety of body dimensions that, in many cases, would be incompatible with the buoyancy compensator vests currently on the market; a device that can be retrofitted on a wide variety of buoyancy compensator vests; a device that makes out-of-the-water use of the buoyancy compensator vest, such as when walking to and from the diving area, be it over a beach or on a boat, more comfortable to use; a device that prevents personal injury including injury to the kidneys from inadvertent contact between the diver and his or her solid air tank; and a device made from inexpensive materials that it can be sold at a reasonable price to be available to many divers who must control their expenses.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE PREFERRED EMBODIMENT

Figure 1:
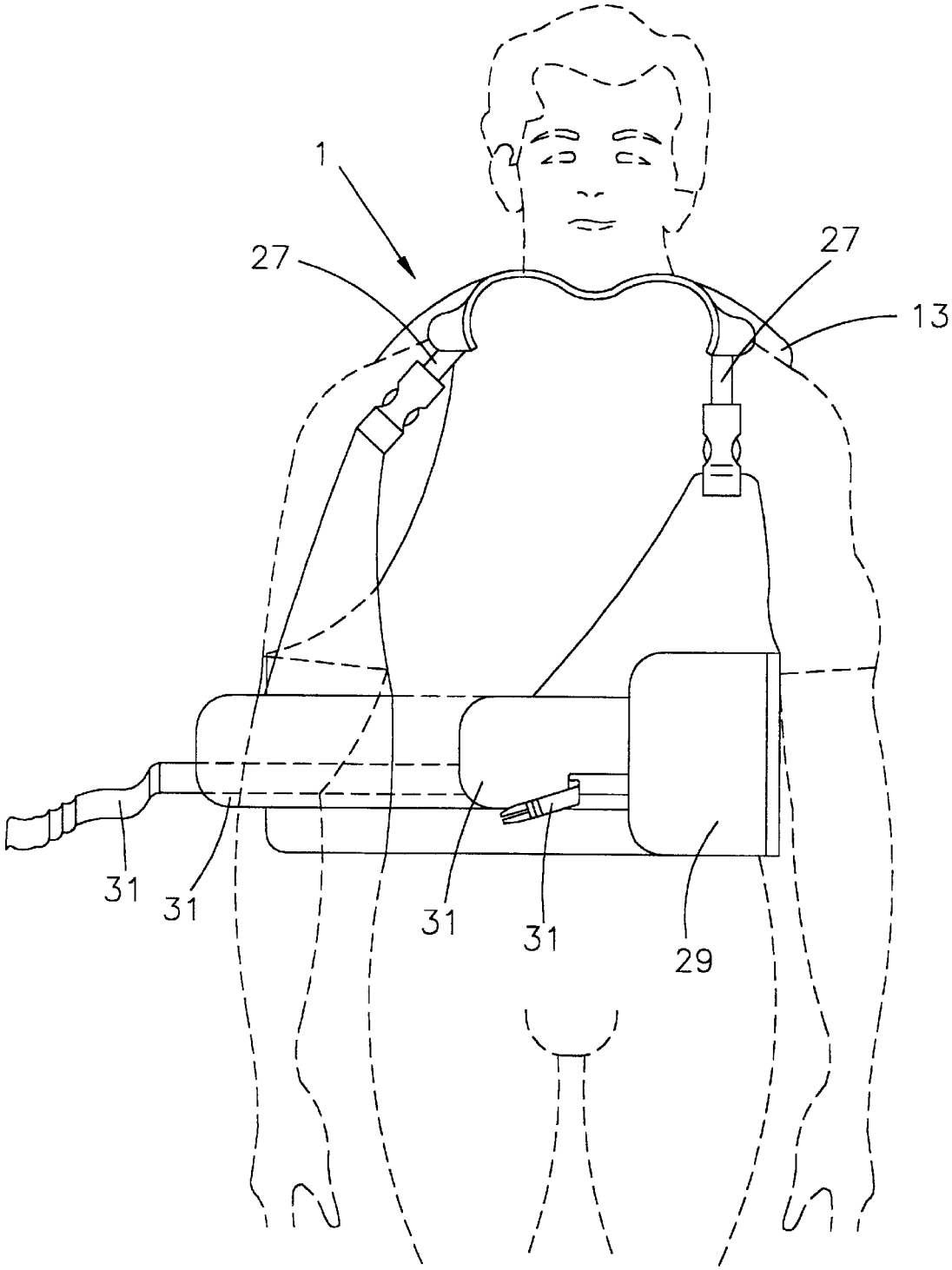
FIG. 1 is a front view of the preferred embodiment of the buoyancy compensator vest of this invention shown in position on a diver outlined in dotted lines.
Figure 2:
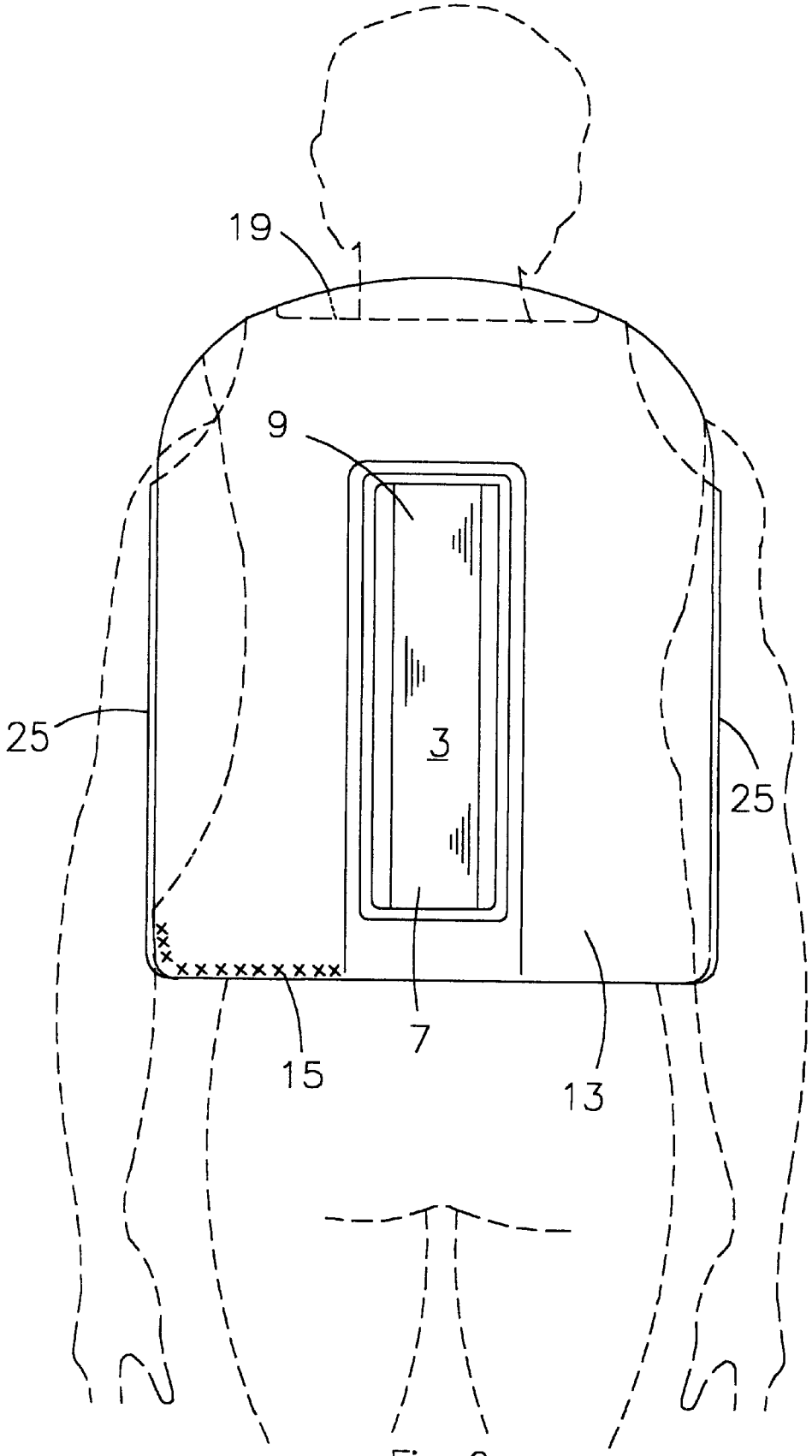
FIG. 2 is a rear view of the preferred embodiment of the buoyancy compensator vest shown in FIG. 1 on a diver outlined in dotted lines.
Figures 3, 4, 5:
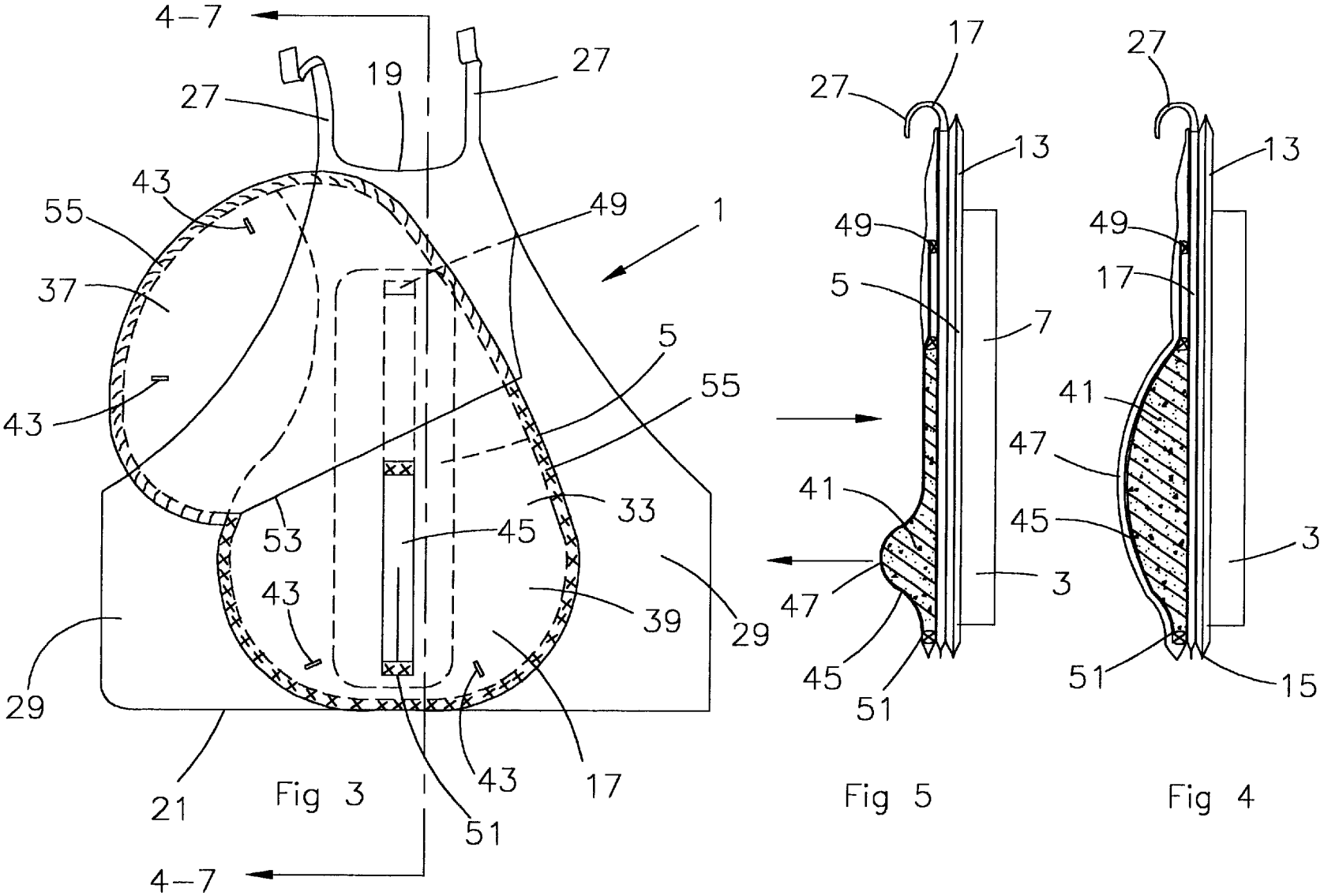
FIG. 3 is a front view of the buoyancy compensator vest shown in FIGS. 1 and 2 showing the pouch and the front panel thereof folded upward to reveal the strap of this invention.
FIG. 4 is a sectional side view of the preferred embodiment of the invention, taken along lines 4-7—4-7 in FIG. 3, with the pouch closed showing the strap of this invention and its assembly inside said pouch.
FIG. 5 is another sectional side view of the preferred embodiment of the invention, taken along lines 4-7—4-7 in FIG. 3, with the pouch closed showing the strap of this invention and its reaction to a force (arrow) applied to the strap.

Turning now to the drawings, wherein elements are identified by numbers and like elements are identified with like numbers throughout the nine figures, FIGS. 1, 2, and 3 show a buoyancy compensator vest, generally indicated at 1, worn by a scuba diver (the scuba diver is shown in dotted outline in FIGS. 1 and 2), for providing buoyancy to the diver at various depths. Buoyancy compensator vest 1 is formed in a configuration having a rigid back board 3, defined by a front and rear surfaces 5 and 7 respectively, and a rounded channel 9 on back board 3 for supporting a standard air or other breathable gas tank (not shown) vertically thereon, on rear surface 7, at the back of the diver by straps (not shown) or other such clasping devices already known in the art.

Back board 3 is surrounded in part by an inflatable bladder 13 that is traditionally made of a pair of matching non-air permeable panels, sewn or otherwise joined about their mating peripheral edges 15 and positioned about back board 3. Bladder 13 includes a valved opening (not shown) for inflating and deflating the volume between the panels with air to make the diver and his or her equipment more buoyant so as to relieve the strain of carrying about one's heavier-than-water body and equipment. All hoses and valves and other components involved with the inflation and deflation of the buoyancy compensator vest have been eliminated from the drawings to reduce the drawings to those items that are involved in the invention.

As shown in FIG. 3, a vest back panel 17 is provided, defined by spaced-apart top and bottom edges, 19 and 21 respectively, and spaced-apart sides 25 (see FIG. 2). Panel 17 further includes a pair of spaced-apart over-the-shoulder straps 27, projecting from top panel edge 19, for joining with a pair of side portions 29, extending from panel sides 25, about the chest of the diver, and one or more belts 31 passing from back board 3 about panel side portions 29 and the user's waist to complete the vest portion of buoyancy compensator vest 1.

In some designs, the vest portion of buoyancy compensator vest 1 is abbreviated and back board 3 is strapped over the shoulders of the diver and around the sides and front of his or her torso while inflatable bladder 13 is attached to back board 3. This invention will perform successfully with either type of design.

The novel improvement of this invention is shown in FIGS. 4, 5, 6 and 7 and comprises a pouch 33, defined by front and rear pouch surface panels 37 and 39 respectively, said pouch 33 is interposed or placed between vest back panel 17 or back board 3 and the diver's back and contains a cushion 41 directed toward the back of the diver or his or her diving suit, as shown in FIGS. 4 and 5, to cushion the diver's spine from contact insults with portions of the air tank. As shown in FIG. 3, pouch 33 has openings 43 formed therein to allow it to fill with water when the diver submerges, and drain water therefrom when the diver emerges from the water.

A flexible strap 45 is located in or about pouch 33, arranged in vertical orientation therein and preferably centered over the diver's spine. Strap 45 is pre-bowed outward at 47, as shown in FIGS. 4 and 5, toward the diver's back. Strap 45 is terminated by spaced-apart upper and lower distal ends 49 and 51, respectively, and the pre-bow is created by either fixing ends 49 and 51 or one or more spaced-apart places on strap 45 a distance apart less than the total, unrestrained rectilinear distance therebetween. In this manner, strap 45 is pre-bowed toward the scuba diver and will not totally collapse even when a portion thereof is subjected to pressure or despite pressure against it from back board 3 or from the air tank through back board 3 as shown by the arrows in FIG. 5. Should one portion of the pre-bowed strap 45 be forced inward, toward the scuba diver such as by contact with the air tank, the rest of the pre-bowed strap will bow further outward thus compensating for the inward force and protecting the spine and other internal parts of the scuba diver's body.

The preferred means of fixing upper strap end 49 is by anchoring it to back board 3 by sewing, gluing, riveting, Velcro® strapping and other such fastening means known in the prior art. The preferred means of fixing lower strap end 51 is by fixing it to vest back panel 17 such as by the same means. In addition, strap 45 may be further restrained by fixing it at one or more places along the length of said strap. This way, there could be multiple pre-bows set in the strap. In addition, it is preferred that flexible strap 45 be located on top of cushion 41, between the cushion and the diver's back. However, other configurations are possible, including locating strap 45 beneath the upper surface of cushion 41, and this configuration is fully contemplated in the invention.

It is preferred that cushion 41 be made of a reticulated foam, such as flexible polyurethane reticulated foam. Reticulated foam contains unsealed cell walls so that all portions of the foam are interconnected and water may pass through the entire foam structure with ease. This way, water can penetrate the entire foam structure easily and can drain from the same structure, unimpeded by cell wall resistance. In the preferred embodiment, flexible strap 45 is located between cushion 41 and pouch front panel 37. In all cases, it is the preferred embodiment that lower strap distal end 51 be located above the illiac crest of the diver's torso, when wearing buoyancy compensator vest 1, so that the air tank and back board 3 do not come in contact with or strike the diver's illiac crest. This crest is populated with many nerve endings that may be severely traumatized by such a strike and cause severe pain to that region of the lumbar area of the diver.

Strap 45 should be made from a material that is unaffected by the water entering pouch 33. For fresh water, the strap may contain one or more of many types of flexible, spring-type material that withstand corrosion, such as plastic, stainless steel, and certain ferrous metal blends. For salt water, however, the types of material useful herein is substantially more narrow and centers around plastics, such as polyurethane plastic, polyethylene plastic, and certain blends of acrylonitrile-butadiene-styrene plastic.

In the preferred embodiment of the invention, pouch 33 should have an openable pouch surface. As shown in FIG. 3, the preferred openable pouch surface is front pouch panel 37 and maybe folded open along a fold line 53 to reveal flexible strap 45 inside pouch 33. The peripheral edges of front pouch panel 37 and rear pouch panel 39 are shown lined with Velcro® brand releasably engageable fastener tape 55 to seal (and unseal) the mating edges together.

Figure 6:
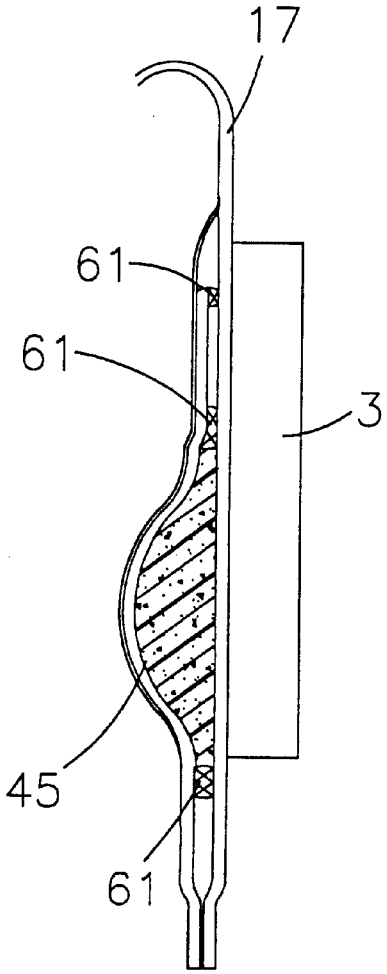
FIG. 6 is another a sectional side view of the preferred embodiment of the invention, taken along lines 4-7—4-7 in FIG. 3, with the pouch closed how the strap is mounted in fixed position in the pouch.
Figure 7:
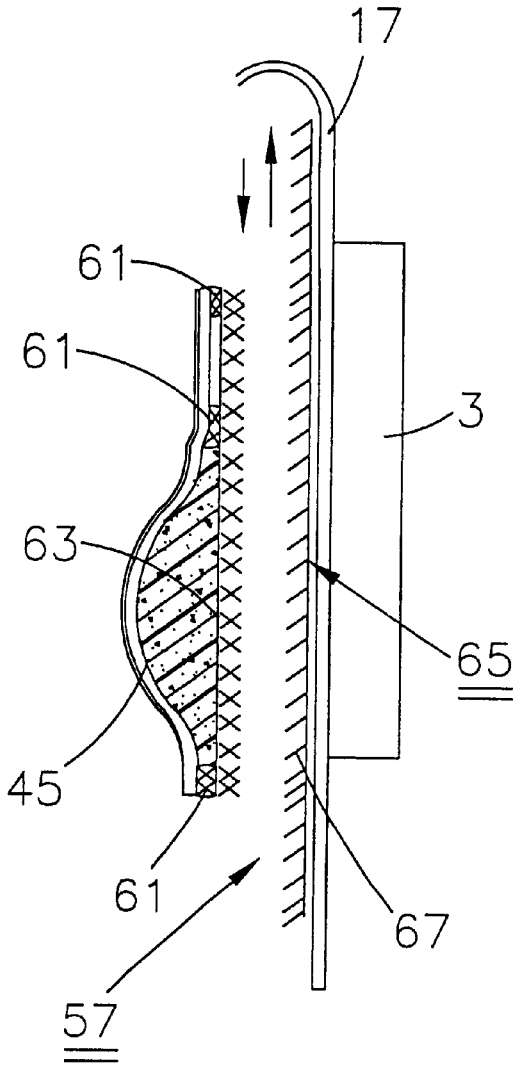
FIG. 7 is another sectional side view of the preferred embodiment of the invention, taken along lines 4-7—4-7 in FIG. 3, with the pouch closed showing the strap of this invention and one embodiment of the means to move the strap vertically inside the pouch.

Another embodiment of this invention shown in FIGS. 6 and 7, and comprises the inclusion of a means 57 to adjust the vertical position of strap 45 to compensate for divers having different torso lengths. This occurs when small children and some women use buoyancy compensator vest 1. In addition, means 57 is needed to adjust back board 3 to a location above the illiac crest of many short people to avoid injury thereto.

As shown in FIGS. 4–6, flexible strap 45 is fixed to back board 3 and vest back panel 17 by mounting blocks 61 that tie strap 45 directly in fixed positions. As shown in FIG. 7, one form of means 57 is to mount strap 45 to a thin strip 63 of rigid material and then provide a mounting means 65 against which to mount thin strip 63 at various locations on either back board 3 or vest back panel 17 or both. As shown in FIG. 7, mounting means 65 is an elongated Velcro® brand releasably engageable fastener tape strip 67 attached by sewing, glue or the like to back board 3 and vest back panel 17. To adjust the vertical position of strap 45, one merely opens pouch 33, by lifting pouch front panel 37, removes strip 63 and strap 45 from their position and relocates strap 45 and strip 63 higher or lower on strip 67. In place of Velcro® strip 67, one may use interlocking tabs, snaps and other such releasably engageable attachments and all are contemplated in this invention.

Figure 8:
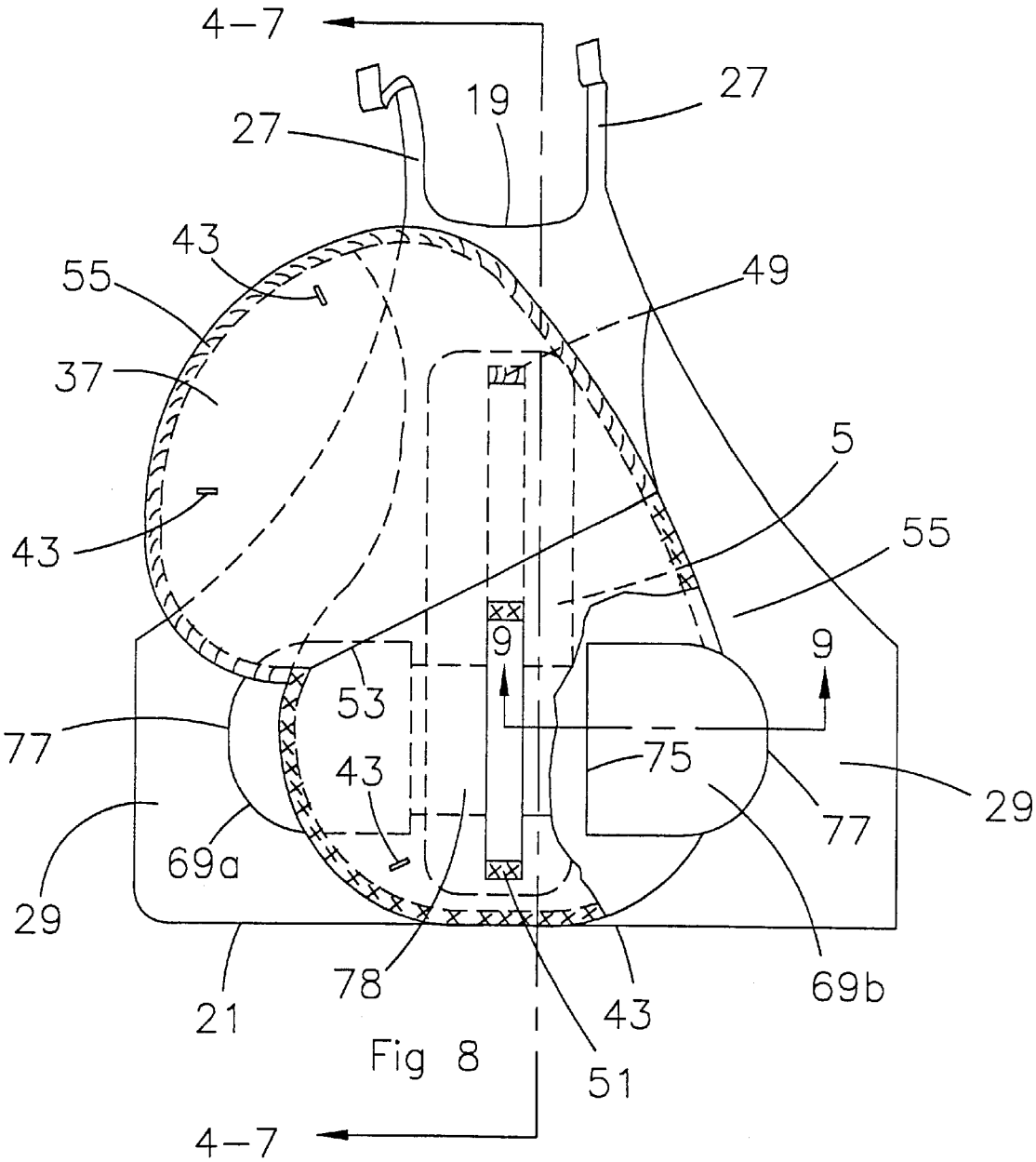
FIG. 8 is a front view of another embodiment of the buoyancy compensator vest of this invention with part of the front panel thereof folded upward to reveal the strap of this invention and a portion broken away to reveal one of the kidney cushions; and, FIG. 9 is a sectional view of the kidney cushion taken along lines 9—9 in FIG. 8.
Figure 9:
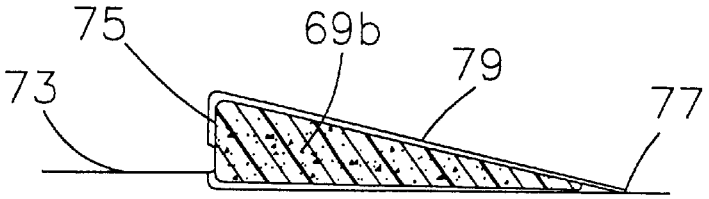

Another embodiment of the invention is shown in FIGS. 8 and 9 wherein a pair of kidney-shaped cushions **69*a* and 69*b* are mounted in spaced-apart and faced-apart arrangement by a waist strap 73 on the inside of vest 1 on either side of vest back panel 17 and spaced along belt 31. As shown in FIG. 9, cushions 69*a* and 69*b* have a triangular cross-section and have a thick side or edge 75 that gradually diminishes, across the cushion, to a sharp-edge 77 and is covered with an exterior layer of wear-resistant material such as canvass, nylon or other such fabric 79. Strap 73 passes from the rear surface of one cushion 69*a* for spanning across the area occupied by back board 3 and flexible strap 45 to the other cushion 69*b*. Cushions 69*a* and 69*b*** protect the kidneys and kidney area of the wearer from impact from the air tank when in and out of the water, and from other parts of a water craft involved in the diving.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. In a buoyancy compensator worn by a scuba diver, for providing buoyancy at various underwater depths, said compensator formed in a configuration having a rigid back board, defined by front and rear surfaces, for supporting an air tank vertically on said rear surface of said board, at the back of the diver, said back board surrounded at least in part by an inflatable/deflatable buoyancy bladder, a valve and hoses for inflating and deflating said bladder, over-the-shoulder straps and a belt passing from behind the diver to the front of said compensator for buckling about the chest of the scuba diver, the improvement comprising:

a) a pouch, defined by front and rear surfaces, interposed said back board and the scuba diver, said pouch containing a cushion directed toward the back of the diver, to cushion said back board and tank against the diver's spine, said pouch having openings formed therein to allow filling and draining of water during underwater activities; and, b) a flexible strap located in said pouch, arranged in vertical orientation therein and defined by upper and lower distal ends, said flexible strap having an outwardly directed pre-bowed portion formed therein, toward the diver's back so that said pre-bowed portion is non-collapsible even when said flexible strap is subjected to pressure along a portion of said pre-bowed portion.

2. The improvement of claim 1 wherein said outwardly directed pre-bow is created by fixing said upper and lower distal ends a distance apart less than the total, unrestrained rectilinear distance therebetween.

3. The improvement of claim 1 wherein said lower end of said flexible strap is fixed to said panel.

4. The improvement of claim 1 wherein said flexible strap is located between said cushion and said front surface of said pouch.

5. The improvement of claim 1 wherein said fixed lower distal end of said flexible strap is located above the illiac crest of the diver's torso when wearing said buoyancy compensator.

6. The improvement of claim 1 wherein said flexible strap is made of plastic.

7. The improvement of claim 1 wherein said cushion in said pouch contains reticulated foam.

8. The improvement of claim 1 wherein said pouch includes an openable panel, to expose the interior thereof.

9. The improvement of claim 1 wherein said openable panel is located at the front surface of said pouch.

10. The improvement of claim 1 further including means for adjusting the vertical position of said flexible strap to compensate for divers having different torso lengths.

11. The improvement of claim 10 wherein said means for adjusting the vertical position of said flexible strap include means for moving at least one end of said flexible strap upward and downward on said panel.

12. The improvement of claim 10 wherein said means for adjusting the vertical position of said flexible strap include means for moving both said distal ends of said flexible strap upward and downward.

13. In a buoyancy compensator vest worn by a scuba diver, for providing buoyancy at various underwater depths, said buoyancy compensator vest formed in a configuration having a rigid back board, defined by front and rear surfaces, for supporting an air tank vertically on the rear surface of said board at the back of the diver, said back board surrounded in part by an inflatable/deflatable bladder including means for inflating and deflating said bladder, and a vest back panel, said vest back panel defined by spaced-apart top and bottom edges, and spaced-apart sides, said vest back panel further including a pair of spaced-apart, over-the-shoulder straps projecting from said top panel edge for joining with a pair of side portions extending one from each said panel sides about the chest of the diver, and a belt passing from behind said compensator vest about said panel side portions and the user's waist for buckling thereabout to complete the vest, the improvement comprising:

a) a pouch, defined by front and rear surfaces and including an openable panel to expose the interior thereof, said pouch interposed said back board and the scuba diver's back and containing a cushion for placement against the back of the diver, to cushion said back board and tank against the diver's spine, said pouch having openings formed therein to allow filling and draining of water during underwater activities; and, b) a flexible strap located in said pouch, arranged in vertical orientation therein, said flexible strap having an outwardly directed pre-bowed portion toward the diver's back and arranged so that said pre-bowed portion is non-collapsible.

14. The improvement of claim 13 wherein said flexible strap is defined by spaced-apart upper and lower distal ends and said lower distal end is located above the illiac crest of the diver's torso.

15. The improvement of claim 13 wherein said flexible strap is made of plastic.

16. The improvement of claim 13 wherein said cushion in said pouch contains reticulated foam for ease in filling said pouch and draining water therefrom.

17. The improvement of claim 13 wherein said openable panel is located at the front surface of said pouch.

18. The improvement of claim 13 further including means for adjusting the vertical position of said flexible strap to compensate for divers having a variable torso length.

19. The improvement of claim 18 wherein said flexible strap is defined by spaced-apart upper and lower distal ends and wherein said means for adjusting the vertical position of said flexible strap include means for moving at least one end of said flexible strap upward and downward on said vest back panel.

20. The improvement of claim 18 wherein said flexible strap is defined by spaced-apart upper and lower distal ends and wherein said means for adjusting the vertical position of said flexible strap include means for moving both said ends of said flexible strap upward and downward on said vest back panel.

21. In a buoyancy compensator worn by a scuba diver, for providing buoyancy at various underwater depths, said compensator formed in a configuration having a rigid back board for supporting an air tank vertically on said rear surface of said board, at the back of the diver, said back board surrounded at least in part by an inflatable/deflatable buoyancy bladder, a valve and hoses for inflating and deflating said bladder, over-the-shoulder straps and a belt passing from behind the diver to the front of said compensator for buckling about the chest of the scuba diver, the improvement comprising:

a) a pouch, defined by front and rear surfaces, interposed said back board and the scuba diver, said pouch containing a cushion directed toward the back of the diver, to cushion said back board and tank against the diver's spine, said pouch having openings formed therein to allow filling and draining of water during underwater activities;

b) a flexible strap located in said pouch, arranged in vertical orientation therein and defined by upper and lower distal ends, said flexible strap having an outwardly directed pre-bowed portion formed therein, toward the diver's back so that said pre-bowed portion is non-collapsible even when said flexible strap is subjected to pressure along a portion of said pre-bowed portion and, c) a pair of kidney-shaped cushions mounted in spaced-apart and faced-apart arrangement on the inside of said vest, one on either side of said back panel to protect the kidneys and kidney area of the wearer from impact from the air tank, when in and out of the water, and from other parts of a water craft involved in the diving.

22. The buoyancy compensator of claim 21 wherein said kidney-shaped cushions are held in spaced-apart arrangement by a waist strap.

23. The buoyancy compensator of claim 22 wherein said kidney-shaped cushions are defined by a triangular cross-section, having a thick edge that gradually diminishes, across the cushion, to a sharp-edge and said cushions are covered with an exterior layer of wear-resistant material.

24. The buoyancy compensator of claim 23 wherein said waist strap, attached between said cushions, passes from said thick edge of one of said kidney-shaped cushions and across the area of said back board to said thick edge of said other kidney-shaped cushion.

* * * * *